US005423497A

United States Patent [19]

Ransom

[11] Patent Number: 5,423,497

[45] Date of Patent: Jun. 13, 1995

[54] CONTROL SYSTEMS FOR MOVING BODIES

[75] Inventor: Richard S. Ransom, Craigavad, Co. Down, Ireland

[73] Assignee: Shorts Missile Systems Limited, Belfast, Ireland

[21] Appl. No.: 512,826

[22] Filed: Dec. 3, 1965

[51] Int. Cl.[6] ..... F42B 10/60

[52] U.S. Cl. ..... 244/3.22; 244/3.21

[58] Field of Search ..... 244/3.11–3.20, 244/3.21, 3.22

[56] References Cited

U.S. PATENT DOCUMENTS 3,010,677 11/1961 Guthrie et al. ..... 244/3.16
3,067,681 12/1962 Beman ..... 244/3.23
3,111,088 11/1963 Fisk ..... 244/3.23

*Primary Examiner*—Ian J. Lobo
*Attorney, Agent, or Firm*—Cushman Darby & Cushman

[57] ABSTRACT

A missile or other moving body comprising a rotatable portion arranged for rotation relative to another portion of the missile or body and control means for rotating said rotatable portion to bring it to any one of a plurality of preselected positions in relation to a datum and for exerting a thrust thereon having a lateral component with respect to the axis of rotation of said rotatable portion to produce a steering effect on the missile or body, said control means including a variable-incidence control surface mounted on the rotatable portion for rotation about a rotary axis transverse to the rotary axis of the rotatable portion, and actuator means responsive to control signals applied thereto for turning said control surface about its rotary axis to a first disposition in which it produces a component thrust causing rotation of said rotatable portion, and a second disposition in which it produces a lateral steering force on the missile.

23 Claims, 3 Drawing Sheets

CONTROL SYSTEMS FOR MOVING BODIES

The present invention relates to control systems for moving bodies and is particularly though not exclusively concerned with a remote control system for an aerial body such as a missile.

In the copending U.S. patent application No. 373881/64, of Sendles, Ser. No. 373,881, filed Jun. 9, 1964, now abandoned in favor of a copending continuation thereof, Ser. No. 660,873, filed Aug. 4, 1967, still pending, there is claimed a missile or other moving body comprising a rotatable portion arranged for rotation relative to another portion of the missile or body, means for rotating said rotatable portion and bringing it to any one of a number of preselected positions in relation to a datum, and means on said rotatable portion for exerting a thrust thereon away from the axis of rotation to produce a steering effect on the missile or body.

It is well known that the cost of control equipment used in a missile represents an appreciable portion of the total manufacturing cost of the missile and attempts are constantly being made to reduce the cost and also the bulk and weight of the control equipment. Such economies are particularly desirable in the case of small missiles and although the missile forming the subject of our copending patent application effects useful economies in this direction it is an object of the present invention to provide an improvement in or modification of the missile forming the subject of the copending application, in which the amount of control equipment is still further reduced.

According to the present invention, there is provided a missile or other moving body comprising a rotatable portion arranged for rotation relative to another portion of the missile or body, and means for rotating said rotatable portion to bring it to any one of a number of preselected positions in relation to a datum and for exerting a thrust thereon away from the axis of rotation to produce a steering effect on the missile or body.

Figure 1:
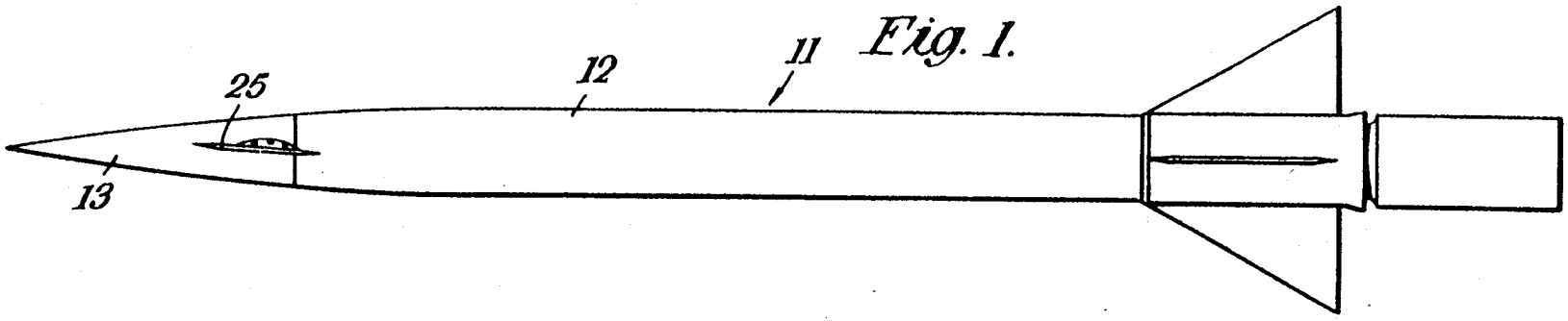
Figure 3:
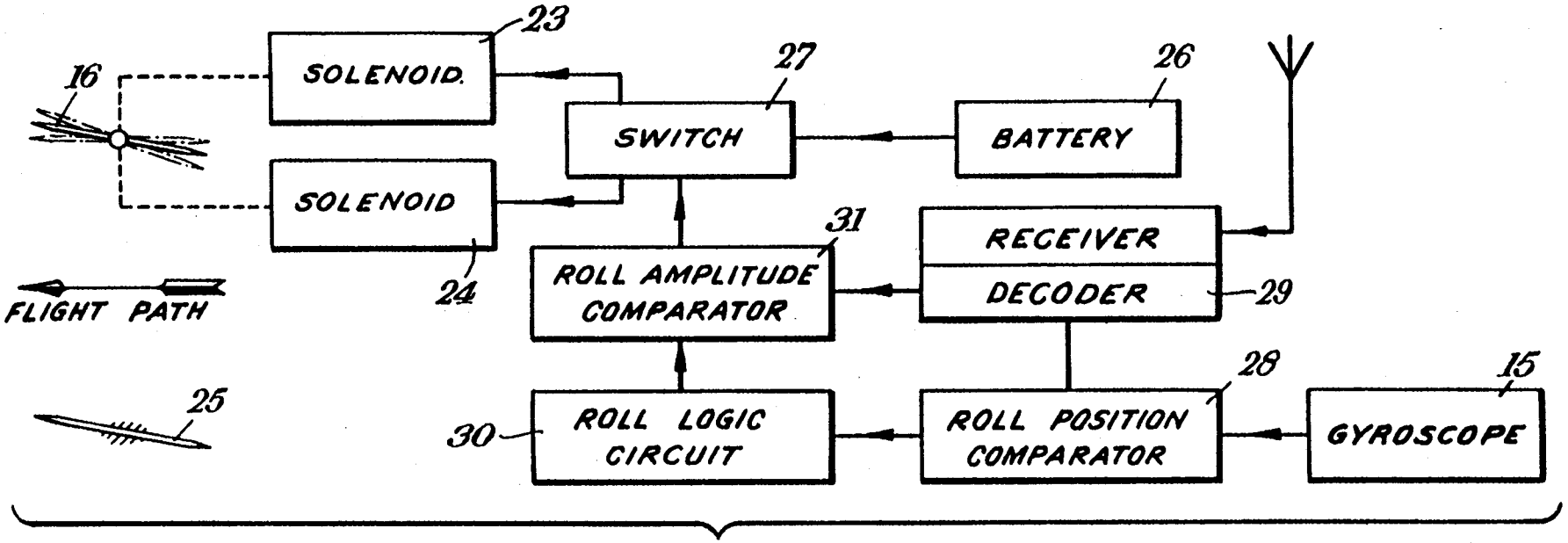
Figure 2:
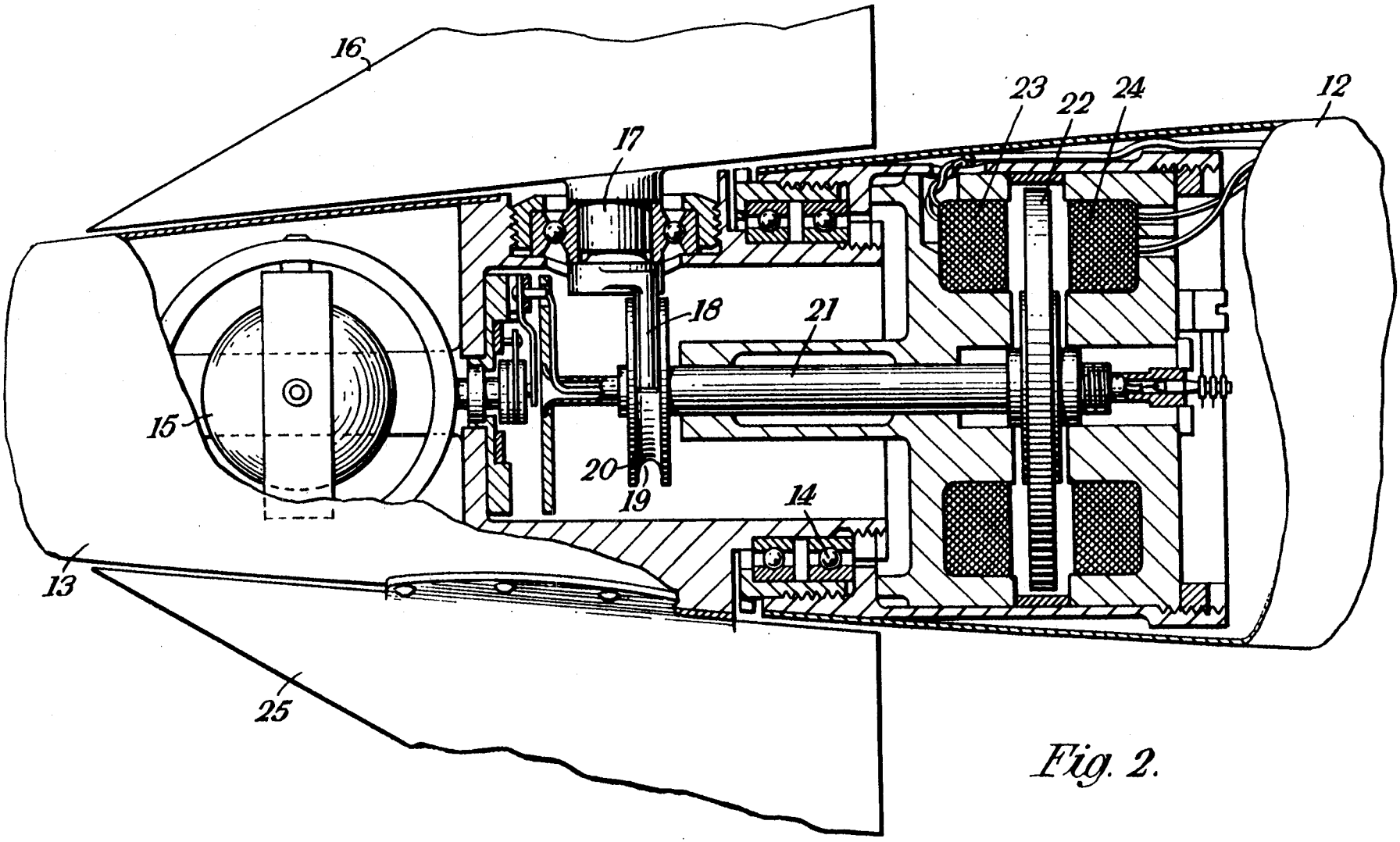
Figure 5:
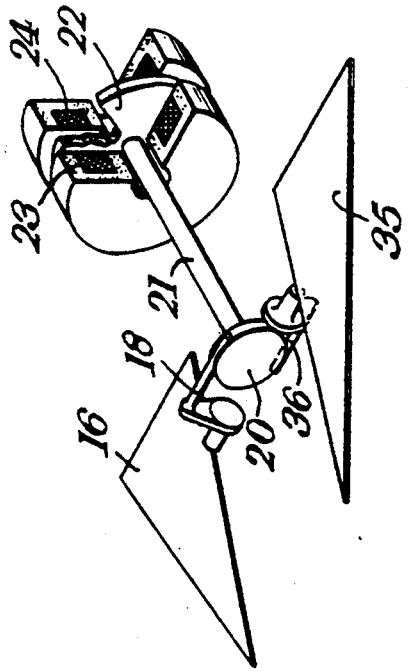
Figure 4:
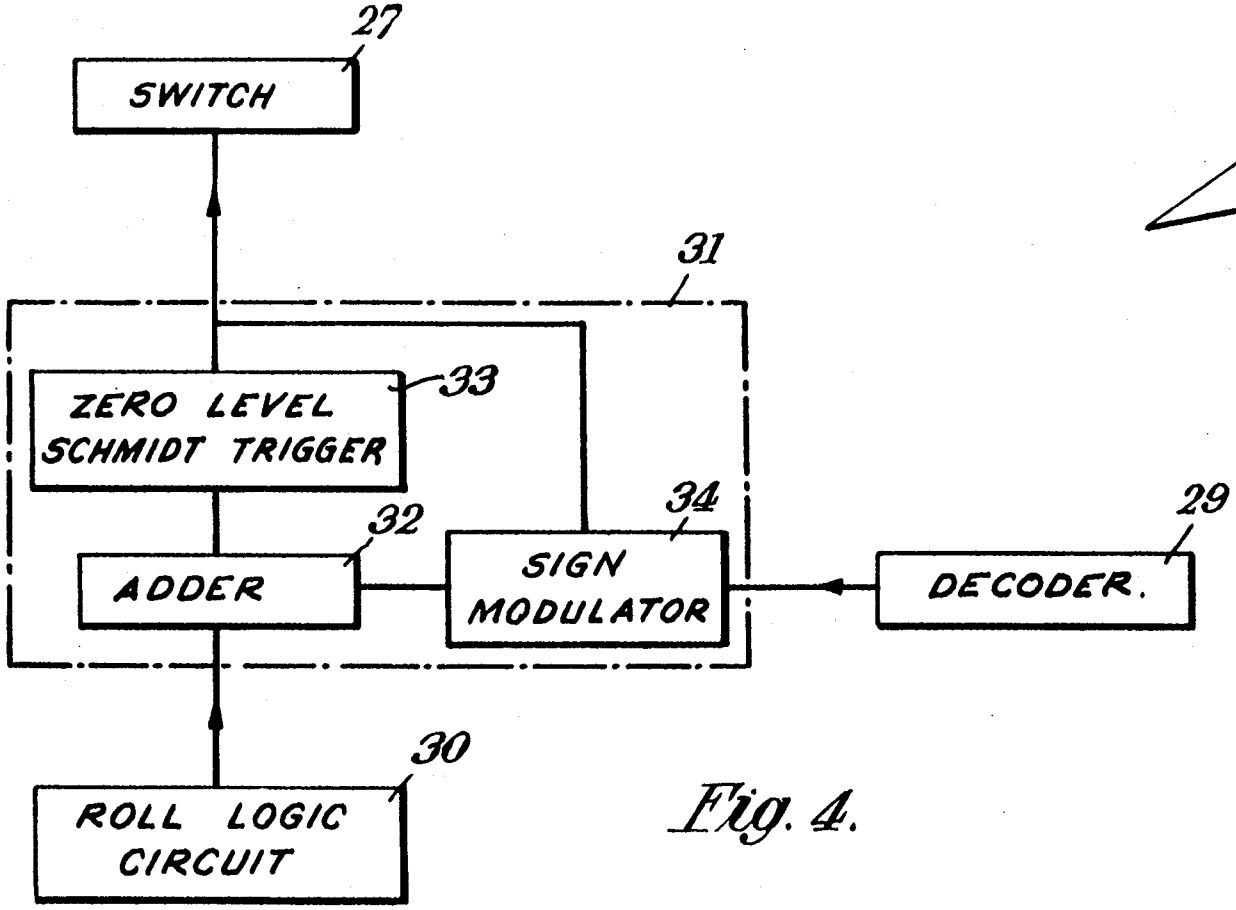

One embodiment of the invention will now be described by way of example with reference to the accompanying drawings in which:

FIG. 1 is a side elevation of a missile according to the invention,

FIG. 2 is a part sectional plan view of a portion of the missile shown in FIG. 1, FIG. 3 is a block schematic diagram of control apparatus housed in the missile, FIG. 4 is a block schematic diagram of part of the apparatus shown in FIG. 3 including details of the contents of one of the units illustrated in FIG. 3, and FIG. 5 is a schematic perspective view of an alternative arrangement of the control surfaces of the missile.

Referring first to FIGS. 1 and 2, a missile 11 comprises a main body portion 12 and a nose portion 13 which is rotatably mounted in bearings 14 on the forward end of the main body portion 12 for rotation about the longitudinal axis of the missile 11 and which houses a free gyroscope 15 which is arranged to generate an electrical signal representative of the roll attitude of the nose portion. The nose portion 13 is provided with a control surface 16 mounted in the nose portion 13 for rotation about a lateral axis passing through the longitudinal axis of the missile 11, the inner end of a shaft 17 supporting the control surface 16 being provided with an eccentrically mounted pin 18 which engages in a peripheral groove 19 in a head 20 of an axially movable push rod 21 coaxial with the rotary axis of the nose portion 13 and extending at one end into the rotatable nose portion 13 and at the other end carrying an armature disc 22 mounted concentrically with respect to the push rod 21 and arranged between and in cooperating relation with a pair of actuator solenoids 23 and 24 mounted in the main body portion 12 and coaxial with the longitudinal axis of the missile 11, the arrangement being such that upon energisation of the solenoid 23 the push-rod 21 is moved forward into the nose portion 13 acting on the eccentrically mounted pin 18 and causing the control surface 16 to be angularly turned in one sense to a first deflected position and upon energisation of the solenoid 24 the push-rod 21 is moved rearward causing the control surface to be angularly turned in the opposite sense to a second deflected position.

A fixed surface 25 of the same shape and size as the movable control surface 16 is fixedly mounted on the other side of the nose portion 13 at a predetermined angle of incidence and the arrangement is such that the movable control surface 16 pivots from one of its two deflected positions to the other through an angle which is equally divided by the plane containing the fixed surface 25 and the pivotal axis of the movable control surface 16, the movable control surface 16 moving to a large angle of incidence at one of its deflected positions, hereinafter referred to as the high incidence position, and moving to a low angle of incidence at its other deflected position, hereinafter referred to as the low incidence position.

The two solenoids 23 and 24 hereinbefore referred to are energised under the control of apparatus housed in the main body portion 12 of the missile 11. The control apparatus is shown in FIG. 3 and includes a battery 26 for supplying energising current to the solenoids 23 and 24 through a changover switch 27 in a first position of which one of the solenoids 23 and 24 is energised and in a second position of which the other of the solenoids 23 and 24 is energised. A roll-position comparator 28 is provided which compares the signal generated by the gyroscope 15 with a roll-demand signal transmitted from the remote control ground station and fed to the comparator 28 from a signal receiver and decoder 29. The output from the comparator 28 is fed to a roll logic circuit 30 as described in our French Patent Application based on British Patent Application No. 50198/64, the output of which is fed via a roll-amplitude comparator 31 to the changover switch 27, which in response thereto switches to the one or other of its two positions according to whether the signal from the roll logic circuit 30 is positive or negative, and the arrangement is such that the changeover switch 27 is moved to a position which will cause by energisation of the appropriate solenoid and the appropriate setting of the movable control surface 16 at one of its two deflected positions rotation of the nose portion 13 via its shorter path to the required roll attitude, whereupon the output from the roll logic circuit becomes zero and changes sign, causing the changeover switch 27 to switch over with the result that the other solenoid becomes energised. The movable control surface 16 moves to its other position and the nose portion rotates in the opposite sense. The movable control surface 16 then hunts about its undeflected position and the nose portion 13 is held at the required roll attitude.

A lateral demand signal is transmitted from the ground station in the form of a mark-space signal and is converted in the decoder 29 to a direct current signal which is applied to the roll-amplitude comparator 31 which in response thereto modifies the amplitude of the output from the logic circuit so that, for example, by an increase in the amplitude of the signal applied to the changeover switch 27, the movable control surface 16 is held for longer times in its deflected positions which results in an increase in the amplitude of the nose roll oscillation and produces a smaller means steering effect on the missile.

Referring now to FIG. 4, the roll amplitude comparator 31 takes the form of a Schmidt trigger circuit with blacklash, with the amount of backlash being varied by the output from the decoder 29. The output of the Schmidt trigger circuit feeds the switch 27 which operates the solenoids 23 and 24 in anti-phase. As shown, the roll amplitude comparator 31 comprises an adder unit 32, a zero-level Schmidt trigger circuit 33 and a sign modulator 34. The trigger circuit 33 is arranged to have an output which is positive for positive inputs thereto and negative for negative inputs thereto. The output signal from the trigger circuit 33 is fed to the sign modulator 34 so that the sign of the output signal is given to the roll amplitude demand output of the decoder 29, which is then summed in the adder unit 32 with the output of the roll logic circuit 30 and the summed signal applied as an input to the Schmidt trigger circuit 33.

In an alternative embodiment of the invention shown in FIG. 5 the fixed surface is replaced by a second movable control surface 35 which pivots in the same manner and through the same angle as that through which the control surface 16 pivots, but which is operated by a further eccentrically mounted pin 36 so arranged as to cause the second control surface 35 to move with but in opposite sense to the first control surface 16, whereby when the first control surface 16 moves to the high incidence positions the second control surface 35 moves to the low incidence position and when the first control surface 16 moves to the low incidence position the second control surface 35 moves to the high incidence position.

What I claim as my invention and desire to secure by Letters Patent is:

1. A missile or other moving body comprising a rotatable portion arranged for rotation relative to a main body portion of the missile or body, and means for rotating said rotatable portion to bring it to any one of a number of preselected positions in relation to a datum and for exerting a thrust thereon away from the axis of rotation to produce a steering effect on the missile or body, said means comprising a control surface pivotally mounted on the rotatable portion on one side thereof for rotation about a lateral axis, an actuating mechanism for turning said control surface in one sense to a first deflected position and in the opposite sense to a second deflected position, and a fixed control surface fixedly mounted on the other side of the rotatable portion at a predetermined angle of incidence, the arrangement being such that the movable control surface pivots from one of its two deflected positions to the other through an angle which is divided by the plane containing the fixed control surface and the pivotal axis of the movable control surface.

2. A missile according to claim 1, wherein the said angle through which the movable control surface pivots is equally divided by said plane.

3. A missile according to claim 2, wherein the movable control surface or each movable control surface has a positive angle of incidence greater than said predetermined angle of incidence in one of its deflected positions and a positive angle of incidence less than said predetermined angle of incidence in its other deflected position.

4. A missile according to claim 3, wherein said actuating mechanism is movable in response to the energisation of an electromagnetic coil or coils forming part of the mechanism and contained in the main body portion of the missile, wherein said coil or coils are mounted in the body portion concentric with respect to the rotary axis of the rotatable portion, and wherein said actuating mechanism comprises an axially movable shaft co-axial with the rotary axis and extending at one end into the rotatable portion and at the other end carrying an armature disc mounted concentrically with respect to the shaft and in cooperating relation with said coil or coils which upon energisation causes or cause the disc and the shaft to move axially to effect actuation of the movable control surface.

5. A missile according to claim 4, said shaft and armature disc being rotatable about the rotary axis of the rotatable portion of the missile.

6. A missile according to claim 4, wherein the actuating mechanism includes a spool provided on the end of the shaft, said spool being co-axial with the rotary axis of the rotatable portion and being engaged by a pin which is carried by the movable control surface, the pin slidably engaging in a peripheral groove in the spool and being constrained thereby to follow the axial displacement of the spool whilst rotating with the rotatable portion.

7. A missile according to claim 6, wherein the pin engaging the spool is carried by a supporting shaft for the movable control surface in such a manner that axial displacement of the spool causes a pivotal turning movement of the movable control surface.

8. A missile according to claim 1, wherein said actuating mechanism is arranged to be operated by control apparatus in the missile, said control apparatus comprising a gyroscope mounted in the rotatable portion of the missile and arranged to generate a signal representative of the attitude of the rotatable portion with respect to a predetermined datum roll attitude in space, a receiver mounted in the missile for receiving a control signal from a remote control station representative of a required roll attitude for the rotatable portion with respect to said datum attitude, a comparator to which the signal generated by the gyroscope and the signal received from the control station are applied to produce a switching signal the sign of which represents the direction in which the rotatable portion is required to turn to reach the required roll attitude, and a switch for controlling the energisation of the actuating mechanism and responsive to said switching signal to cause movement of the movable control surface to the appropriate deflected position in response to a switching signal of one sign and to cause movement of the movable control surface to the other deflected position in response to a switching signal of opposite sign.

9. A missile according to claim 8, wherein means are provided for modifying the switching signal in response to a lateral demand signal transmitted from the remote station so that by an increase in the amplitude of the signal applied to the switch the movable control surface is held for longer times in its deflected positions resulting in an increase in the amplitude of the roll oscillation of the rotatable portion and producing a smaller mean steering effect on the missile and by a decrease in the amplitude of the signal applied to the switch the movable control surface is held for shorter times in its deflected positions resulting in a decrease in the amplitude of the roll ascillation of the rotatable portion and a greater mean steering effect on the missile.

10. A missile according to claim 1, wherein said first rotatable portion is constituted by a nose portion of the missile which is mounted for rotation about the longitudinal axis of the missile on the forward end of the main body portion of the missile.

11. A missile or other moving body comprising a rotatable portion arranged for rotation relative to a main body portion of the missile or body, and means for rotating said rotatable portion to bring it to any one of a number of preselected positions in relation to a datum and for exerting a thrust thereon away from the axis of rotation to produce a steering effect on the missile or body, said means comprising a first movable control surface pivotally mounted on the rotatable portion on one side thereof for rotation about a lateral axis, a second movable control surface pivotally mounted on the rotatable portion on the other side thereof for rotation about the same lateral axis as the first control surface, and an actuating mechanism to cause said first movable control surface to turn between first and second deflected positions and the second movable control surface to turn between said positions in the same manner as but in the opposite direction to said first movable control surface, each movable control surface in pivoting from one of its two deflected positions to the other is moved through an angle which is divided by a plane inclined at a predetermined angle of incidence and containing the pivotal axis of the movable control surface moved.

12. A missile or other moving body comprising a rotatable portion arranged for rotation relative to another portion of the missile or body and control means for rotating said rotatable portion to bring it to any one of a plurality of preselected positions in relation to a datum and for exerting a thrust thereon having a lateral component with respect to the axis of rotation of said rotatable portion to produce a steering effect on the missile or body, said control means including a variable-incidence control surface mounted on the rotatable portion for rotation about a rotary axis transverse to the rotary axis of the rotatable portion, and actuator means responsive to control signals applied thereto for turning said control surface about its rotary axis to a first disposition in which it produces a component thrust causing rotation of said rotatable portion, and a second disposition in which it produces a lateral steering force on the missile.

13. A missile or other moving body comprising a rotatable portion arranged for rotation relative to another portion of the missile or body, a first aerodynamic control surface fixedly mounted on the rotatable portion at a predetermined angle of incidence, a variable-incidence aerodynamic control surface mounted on the rotatable portion for rotation about a rotary axis transverse to the rotary axis of the rotatable portion and actuator means responsive to control signals applied thereto for turning said variable-incidence control surface about its rotary axis to bring it to either of two dispositions in each of which it produces with said fixed control surface a thrust on said rotatable portion having a lateral component with respect to the axis of rotation of said rotatable portion to produce a steering effect on the missile, in one of which it produces with said fixed control surface a component thrust causing rotation of said rotatable portion in one direction and in the other of which it produces with said fixed control surface a component thrust on said rotatable portion causing rotation of said rotatable portion in the opposite sense.

14. A missile or other moving body comprising a rotatable portion arranged for rotation relative to another portion of the missile or body about a longitudinal axis of the missile or body, a pair of variable-incidence aerodynamic control surfaces mounted on the rotatable portion for rotation about a rotary axis transverse to the rotary axis of the rotatable portion and actuator means responsive to control signals applied thereto for turning said control surfaces about their rotary axes between two dispositions in each of which the control surfaces produce together a thrust on said rotatable portion having a lateral component with respect to the axis of rotation of said rotatable portion to produce a steering effect on the missile, in one of which they produce a component thrust causing rotation of said rotatable portion in one direction and in the other of which they produce a component thrust on said rotatable portion causing rotation of said rotatable portion in the opposite direction.

15. A missile according to claim 14, wherein each variable-incidence control surface pivots from one of its dispositions to the other through an angle which is divided by a plane inclined at a predetermined angle of incidence and containing the pivotal axis of the variable-incidence control surfaces.

16. A missile according to claim 15, wherein the said angle through which each control surface pivots is equally divided by said plane.

17. A missile according to claim 16, wherein each control surface has a positive angle of incidence greater than said predetermined angle of incidence in one of its two deflected positions and a positive angle of incidence less than said predetermined angle of incidence in its other deflected position.

18. A missile according to claim 17, wherein said actuating mechanism is arranged to be operated by control apparatus in the missile, said control apparatus comprising a gyroscope mounted in the rotatable portion of the missile and arranged to generate a signal representative of the attitude of the rotatable portion with respect to a predetermined datum roll attitude in space, a receiver mounted in the missile for receiving a control signal from a remote control station representative of a required roll attitude, a comparator to which the signal generated by the gyroscope and the signal received from the control station are applied to produce a switching signal the sign of which represents the direction in which the rotatable portion is required to turn to reach the required roll attitude, and a switch for controlling the energization of the actuating mechanism and responsive to said switching signal to cause movement of each control surface to the appropriate deflected position in response to a switching signal of one sign and to cause movement of each control surface to the other deflected position in response to a switching signal of opposite sign.

19. A missile according to claim 14, wherein said first rotatable portion is constituted by a nose portion of the missile which is mounted for rotation about the longitudinal axis of the missile on the forward end of the main body portion of the missile.

20. A missile according to claim 14, wherein said actuating mechanism is movable in response to the energization of an electromagnetic coil or coils forming part of the mechanism and contained in the main body portion of the missile, wherein said coil or coils are mounted in the body portion concentric with respect to the rotary axis of the rotatable portion, and wherein said actuating mechanism comprises an axially movable shaft coaxial with the rotary axis and extending at one end into the rotatable portion and at the other end carrying an armature disc mounted concentrically with respect to the shaft and in cooperating relation with said coil or coils which upon energization causes or cause the disc and the shaft to move axially to effect actuation of the variable-incidence control surfaces.

21. A missile according to claim 20, wherein the shaft and armature disc are rotatable about the rotary axis of the rotatable portion of the missile.

22. A missile according to claim 21, wherein the actuating mechanism includes a spool provided on the end of the shaft, said spool being coaxial with the rotary axis of the rotatable portion and being engaged by a pin which is carried by each control surface, each pin slidably engaging in a peripheral groove in the spool and being constrained thereby to follow the axial displacement of the spool whilst rotating with the rotatable portion.

23. A missile according to claim 22, wherein each pin engaging the spool is carried by a supporting shaft for the control surface in such a manner that axial displacement of the spool causes a pivotal turning movement of the movable control surface.

* * * * *